US008328047B2

(12) United States Patent
Walters et al.

(10) Patent No.: US 8,328,047 B2
(45) Date of Patent: Dec. 11, 2012

(54) ROBUST POUCH AND VALVE ASSEMBLY FOR CONTAINING AND DISPENSING A FLUENT SUBSTANCE

(75) Inventors: Peter J. Walters, Barrington, IL (US); Mark G. Neuhalfen, Mount Prospect, IL (US)

(73) Assignee: AptarGroup, Inc., Crystal Lake, IL (US)

( * ) Notice: Subject to any disclaimer, the term of this patent is extended or adjusted under 35 U.S.C. 154(b) by 510 days.

(21) Appl. No.: 12/611,226

(22) Filed: Nov. 3, 2009

(65) Prior Publication Data

US 2011/0101025 A1 May 5, 2011

(51) Int. Cl.
*B65D 35/28* (2006.01)

(52) U.S. Cl. ..... 222/95; 222/105; 222/386.5; 222/402.1

(58) Field of Classification Search ..... 222/105, 222/386.5, 402.1, 95
See application file for complete search history.

(56) References Cited

U.S. PATENT DOCUMENTS

| | | | | |
|---|---|---|---|---|
| 4,969,577 | A | 11/1990 | Werding | |
| 5,169,037 | A | 12/1992 | Davies et al. | |
| RE35,540 | E | 6/1997 | Davies et al. | |
| 6,273,307 | B1 | 8/2001 | Gross et al. | |
| 6,439,429 | B1 | 8/2002 | Gross | |
| 6,679,304 | B1 * | 1/2004 | Vacca | 141/313 |
| 6,752,264 | B2 * | 6/2004 | Versluys | 206/219 |
| 6,851,578 | B2 * | 2/2005 | Hagihara | 222/107 |
| 6,854,888 | B1 | 2/2005 | Brown et al. | |
| 6,860,406 | B2 * | 3/2005 | Kobetsky et al. | 222/92 |
| 7,021,505 | B2 * | 4/2006 | Franczyk | 222/541.1 |
| RE39,520 | E | 3/2007 | Hess, III et al. | |
| 7,198,179 | B2 * | 4/2007 | Gilkerson et al. | 222/402.1 |
| 7,284,681 | B2 * | 10/2007 | Hagihara | 222/107 |
| D566,554 | S * | 4/2008 | Braukmann et al. | D9/453 |
| 7,350,669 | B2 * | 4/2008 | Rani | 222/92 |
| D574,241 | S * | 8/2008 | Braukmann et al. | D9/453 |
| 7,523,767 | B2 * | 4/2009 | Pericard | 141/10 |
| 7,584,593 | B2 * | 9/2009 | Murray | 53/564 |
| 7,762,430 | B2 * | 7/2010 | Wild et al. | 222/107 |
| 2008/0314475 | A1 | 12/2008 | Fransen | |

FOREIGN PATENT DOCUMENTS

| | | | |
|---|---|---|---|
| EP | 0 585 908 | A2 | 3/1994 |
| WO | WO 2009/027068 | A1 | 3/2009 |

OTHER PUBLICATIONS

International Search Report and Written Opinion dated Dec. 27, 2010.
Figs. 1-4 as filed in the application and included herewith.

* cited by examiner

*Primary Examiner* — Kevin P Shaver
*Assistant Examiner* — Donnell Long
(74) *Attorney, Agent, or Firm* — Wood, Phillips, Katz, Clark & Mortimer

(57) ABSTRACT

A package (52) is provided for containing and dispensing a fluent product. The package (52) includes a fitment body (18) having a tailpiece (40) defining a dispensing passage (19) extending along a longitudinal axis (23), and a collapsible pouch (12) for containing a fluent product to be dispensed, the pouch (12) defined by at least two opposing, flexible, web portions (24). The fitment body (18) extends from a dispensing end (33) of the pouch (12) with the tailpiece (40) being sandwiched between the flexible web portions (24), and the flexible web portions (24) being welded to each other and to the tailpiece (40) to define a robust weld structure (54).

15 Claims, 13 Drawing Sheets

ROBUST POUCH AND VALVE ASSEMBLY FOR CONTAINING AND DISPENSING A FLUENT SUBSTANCE

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

TECHNICAL FIELD

This invention relates to packages for containing a fluent product wherein the package includes a collapsible pouch and a fitment body or assembly for dispensing the fluent product, and in more particular applications to such a package for use in a pressurized container.

BACKGROUND OF THE INVENTION AND TECHNICAL PROBLEMS POSED BY THE PRIOR ART

Collapsible pouches are typically used for packaging a wide variety of products involving food, beverages, personal care products, household care products, or other similar or dissimilar products which may be in the form of a liquid, lotion, gel, paste, or the like. Such a pouch is typically made from a flexible, heat-sealable, polymeric sheet or from a flexible, paperboard or metal foil sheet having a heat-sealable, polymeric lining. The pouch typically has two, opposed, flexible web portions peripherally sealed to one another so as to define an interior region, which is adapted to contain the fluent product, and also to define an opening for establishing communication between the pouch interior region and the exterior of the pouch. The opening is adapted to receive a dispensing fitment assembly, which may incorporate a dispensing valve, and a removable cover, or other similar or dissimilar features, and which typically further includes a fitment body molded from a polymeric material that can be heat-sealed to the web portions of the collapsible pouch. Such constructions are commonly referred to as Bag-On-Valve ("BOV") packages. Some examples of BOV packages can be seen in U.S. Pat. No. RE 39,520 E, issued Mar. 20, 2007; U.S. Pat. No. 6,439,429, issued Aug. 27, 2002; and U.S. Pat. No. 6,273,307 issued Aug. 14, 2001.

It is known to utilize such BOV packages in dispensing systems that utilize a container that is pressurized with a propellant. In such pressurized systems, the pouch of the BOV package is inserted into a pressure capable container with a portion of the fitment assembly engaging an insertion opening of the container to close the container with the pouch hanging from the fitment assembly inside the container. Examples of such dispensing systems can be seen in U.S. Pat. No. Re. 35,540, issued Jun. 24, 1997 and in U.S. Pat. No. 5,169,037, issued Dec. 8, 1992. The weight of the fluent product contained in the collapsible pouch is known to cause stresses in the web portions of the pouch immediately adjacent the fitment body, particularly when the pressurized dispensing system is subjected to impact loads such as when being dropped from a height onto a hard surface. These stresses have been known to cause failures in BOV packages and there is a continuing need to make such constructions more robust in order to reduce such failures.

FIGS. 1-4 illustrate various embodiments of known Bag-On-Valve package constructions. In each of the constructions, the Bag-On-Valve package 10 includes a collapsible pouch 12 and a fitment assembly 14 as previously described. The fitment assembly 14 includes a valve assembly 16 for dispensing a fluent product, a fitment or valve body 18 for mounting the valve 16 in a dispensing passage 19, a dip tube 20 extending from the passage 19 of fitment body 18 into a lower portion of the interior of the pouch 12, and a mounting cup 22 for mounting the package 10 to a fill opening of a pressure capable container. The dispensing passage 19, valve 16 and dip tube 20 extend along a longitudinal axis 23.

The pouch 12 includes two flexible web portions 24 (one facing away from the page), as previously described, that are joined by a pair of laterally spaced, longitudinally extending edge welds 26 defined by inner and outer weld margins 28 and 30, and by a laterally extending top or end weld 32 located at a top or dispensing end 33 of the pouch 12 and bounded by inner and outer weld margins 34 and 36, with the end weld 32 being formed by welding the flexible web portions 24 to each other and to a tailpiece 40 of the fitment body 18. In this regard, the end weld 32 may be formed in a single step process wherein the tailpiece 40 of the fitment body 18 is sandwiched between the flexible web portions 24 and the end weld 32 is formed in a single welding step, or in a multi-step weld process wherein the tailpiece 40 is either first tack welded to the flexible web portions 24 with one or more subsequent weld steps forming the final end weld 32, or wherein the flexible web portions 24 are welded to each other with an opening left for the tailpiece 40 in a first step, the tailpiece 40 inserted into the opening in a second step, and the final form of the end weld 32 being accomplished in one or more subsequent weld steps. As best seen in FIGS. 1 and 2, the pouches 12 may also include gusset welds 38 to define one or more gussets 42 at the bottom of the pouch 12. The welds can be formed using a variety of methods, including heat induction, heat conduction, ultrasonic welding, friction welding, and the like.

In each of the packages 10 of FIGS. 1-4, the portion of the end weld 32 extending across the tailpiece 40 has a maximum width $W_T$ parallel to the longitudinal axis 23. In the package 10 of FIG. 1, the inner and outer weld margins 34 and 36 are straight lines that extend perpendicular to the longitudinal axis 23 and parallel to each other over the entire lateral length of the end weld 32. In the embodiments of FIGS. 2-4, the inner and outer weld margins 34 and 36 initially extend perpendicular to the longitudinal axis 23 and then slope downwardly as they extend laterally away from the longitudinal axis 23, with the width $W_T$ being maintained over a portion of the end weld 32 that extends laterally past the tailpiece 40 and the spacing between the inner and outer weld margins 34 and 36 being reduced in the sloped regions of the end weld 32. While each of these prior art BOV packages 10 may perform acceptably for their intended function, there is always room for improvement.

SUMMARY OF THE INVENTION

In accordance with one form of the invention, a package is provided for containing and dispensing a fluent product. The package includes a fitment body having a tailpiece defining a dispensing passage extending along a longitudinal axis, and a collapsible pouch for containing a fluent product to be dispensed, the pouch defined by at least two opposing, flexible, web portions. The fitment body located at a dispensing end of the pouch with the tailpiece being sandwiched between the flexible web portions, and the flexible web portions being welded to each other to define a pair of laterally spaced, longitudinally extending edge welds and further being welded to each other and to the tailpiece to define an end weld bounded by inner and outer weld margins extending laterally across the pouch at the dispensing end. The portion of the end weld extending across the tailpiece has a maximum width $W_T$ parallel to the longitudinal axis. The flexible web portions are welded to each other at a pair of locations, with the locations being spaced laterally from each other on opposite sides of the longitudinal axis, each of the locations being spaced laterally from the edge welds, and each of the locations being spaced from the outer weld margin by a distance $D_L$ that is greater than the width $W_T$, with $D_L$ being measured along a line extending from the location to the outer weld margin normal to the slope of the outer weld margin at the point where the line intersects the outer weld margin.

As one feature, the outer weld margin is a straight line extending normal to the longitudinal axis.

According to another feature, the outer weld margin does not extend in a continuous straight line from the central axis to the edge welds.

In one feature, the locations are symmetrical about the longitudinal axis.

As one feature, the locations are spaced from the end weld.

In another feature, the locations are defined within the end weld.

As a further feature, the inner weld margin is spaced from the outer weld margin by a distance $D_M$ measured along a line extending normal to the slope of the outer weld margin, the distance $D_M$ increasing in magnitude from $W_T$ to $D_L$ as the inner weld margin extends laterally from the tailpiece to each of the locations and then decreasing from $D_L$ as the inner weld margin extends laterally from each of the locations toward opposite lateral edges of the pouch.

According to one feature, the locations are spaced from the longitudinal axis so as to not underlie the tailpiece.

In one feature, the lateral spacing of the locations from the longitudinal axis is not greater than $4.5*W_T$.

According to one feature, $D_L$ is greater than $1.1*W_T$.

As one feature, $D_L$ is less than $4.5*W_T$.

In one feature, each of the locations is associated with a continuous area of weld that is at least equal to $\pi*(W_T/16)^2$.

According to one feature, the tailpiece has a non-circular transverse cross-section. In a further feature, the transverse cross-section of the tailpiece does not vary over a longitudinal portion of the tailpiece bounded by the inner and outer weld margins. In yet a further feature, the transverse cross-section is generally diamond-shaped.

Other objects, features, and advantages of the invention will become apparent from a review of the entire specification, including the appended claims and drawings.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the components of this invention and the container employed with the components of this invention are described in the normal (upright) operating position. Terms such as upper, lower, horizontal, etc., are used with reference to this position. It will be understood, however, that the components embodying this invention may be manufactured, stored, transported, used, and sold in an orientation other than the position described.

Figures illustrating the components of this invention and the container show some conventional mechanical elements that are known and that will be recognized by one skilled in the art. The detailed description of such elements is not necessary to an understanding of the invention, and accordingly, is herein presented only to the degree necessary to facilitate an understanding of the novel features of the present invention.

Figure 5:
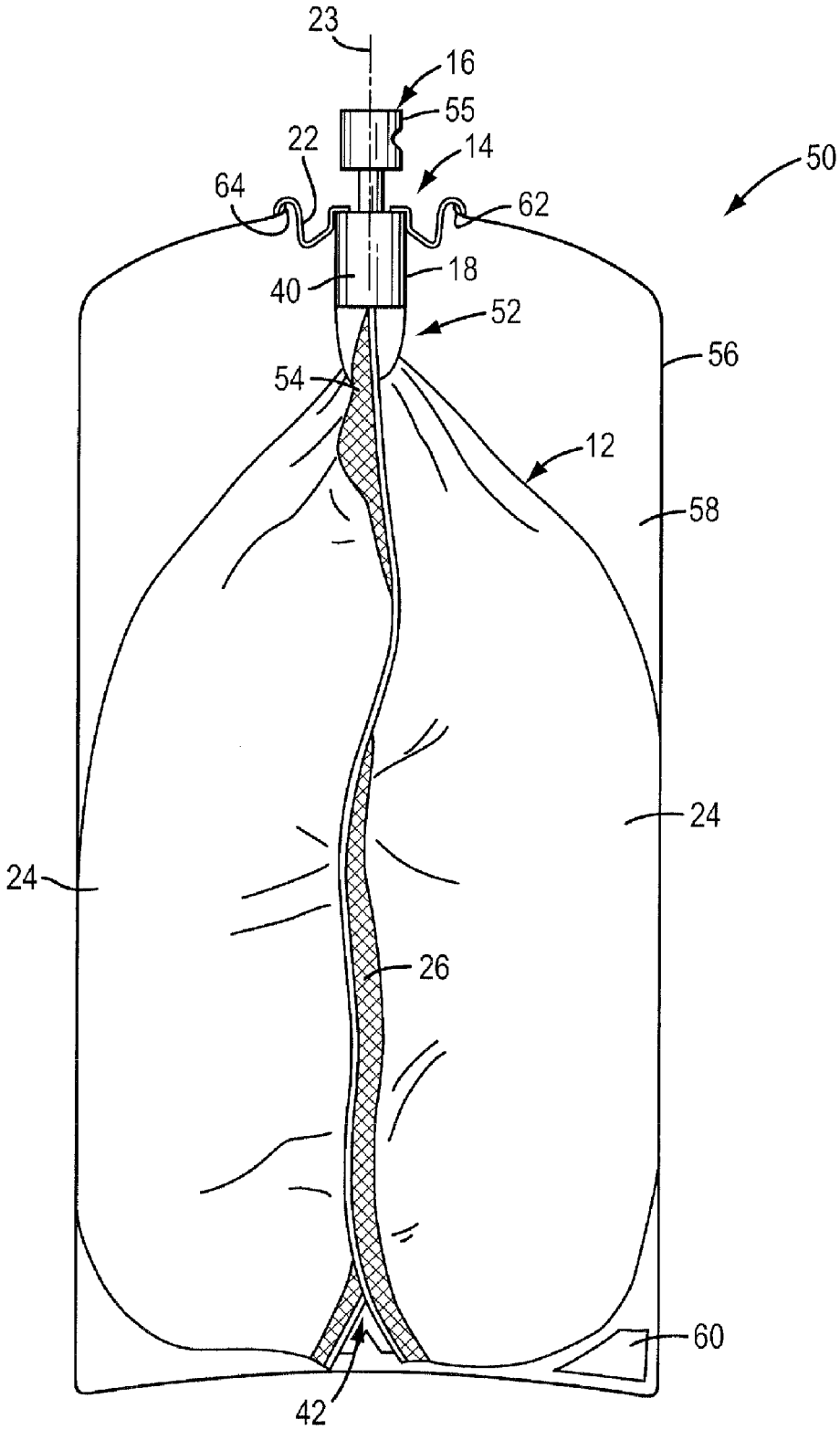
FIG. 5 is an illustration of a pressurized dispensing unit incorporating a Bag-On-Valve package embodying the invention installed in a pressurized container which is shown diagrammatically.

FIG. 5 illustrates a pressurized dispensing unit 50 including a Bag-On-Valve package 52 that has been filled with a product to be dispensed, and that has a robust weld configuration 54 embodying the present invention. The package 52 includes a collapsible pouch 12 and a fitment assembly 14, as previously described in the Background Section of the application with the exception of the robust weld configuration 54 embodying the invention. In this regard, the pouch 12 and the fitment assembly 14, including the dispensing valve 16 (shown in FIG. 5 with a spray nozzle 55), the fitment body 18, the dip tube 20 (not shown in FIG. 5), and the mounting cup 22, can be of any suitable configuration, many of which are known, as dictated by the particular application intended for the dispensing structure 50.

The unit 50 includes a pressure capable container 56 having an interior chamber 58 for the pouch 12 and a propellant, shown schematically at 60. The container 56 and propellant 60 can be of any suitable type or construction (many of which are known) as dictated by the requirements of each particular application. The pouch 12 and tailpiece 40 of the package 52 are assembled into the container in a standard fashion by rolling the empty pouch 12 into a generally cylindrical form and then inserting the pouch 12 and tailpiece 40 through an insertion opening 62 of a pressure capable container 56, with the mounting cup 22 being sealably attached to a rim 64 of the container 56 surrounding the opening 62 using any suitable means of attachment, many of which are known. After the pouch 12 is assembled into the container 56, fluent product can be loaded into the pouch 12 via the valve assembly 16. The fluent product may be a food, beverage, personal care product, household product, safety product, or other similar or dissimilar product in the form of a liquid, gas, suspension, paste, gel, powder, particles, etc.

The collapsible pouch 12, which can be of special or conventional design, is typically and preferably made from a flexible, heat sealable, polymeric sheet or from a multi-layer laminate including a flexible, paperboard or metal foil sheet having a heat-sealable, polymeric lining so as to have the two opposed, flexible web portions 24 that are heat sealed to one another at their peripheral edges to define an interior region for containing the fluent product. The multi-layer laminate can be an extrusion-laminated film or an adhesive-laminated film. The layers of the laminate may include a gas barrier layer, a thermal stability layer, and the like, along with appropriate bonding layers bonding the various layers together.

Figure 6:
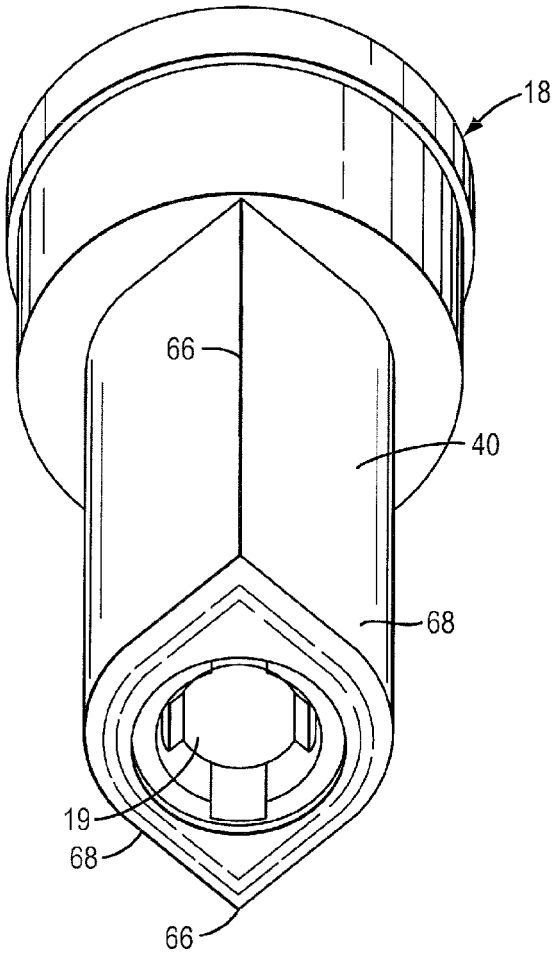
FIG. 6 is an isometric view from below showing a fitment body of the Bag-On-Valve package of FIG. 5.
Figure 7:
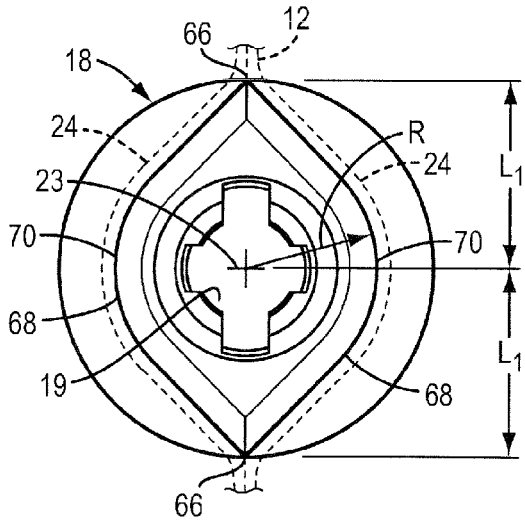
FIG. 7 is a bottom view of the fitment body shown in FIG. 6.

While any suitable construction may be utilized for the fitment body 18 and associated tailpiece 40, one preferred construction is shown in FIGS. 6 and 7 wherein the tailpiece 40 has a generally diamond-shaped or "boat"-shaped transverse cross section that does not vary over the longitudinal length of the tailpiece 40. In this regard, the tailpiece 40 has two laterally spaced, longitudinally extending edges 66 with front and back faces 68 extending between the edges 66 for engagement with the web portions 24 of the pouch 12 (shown in phantom in FIG. 7). The front and back faces 68 have rounded apexes 70. The fitment body 18, or at least the tailpiece 40, is preferably molded from a thermoplastic material such as polyethylene, polypropylene, ABS, styrene, or the like.

It should be understood that while a preferred form of the fitment body 18 and tailpiece 40 are shown in FIGS. 6 and 7, other forms can be utilized in the invention. For example, the tailpiece 40 could have a circular transverse cross section that does not vary over the longitudinal length of the tailpiece 40 so as to define a cylindrical outer surface for the tailpiece 40 for engagement with the web portions 24, or, by way of further example, the tailpiece could have a transverse cross section that does vary over its longitudinal length, one example of which is shown in previously referenced U.S. Pat. No. 6,439,429.

Figure 8:
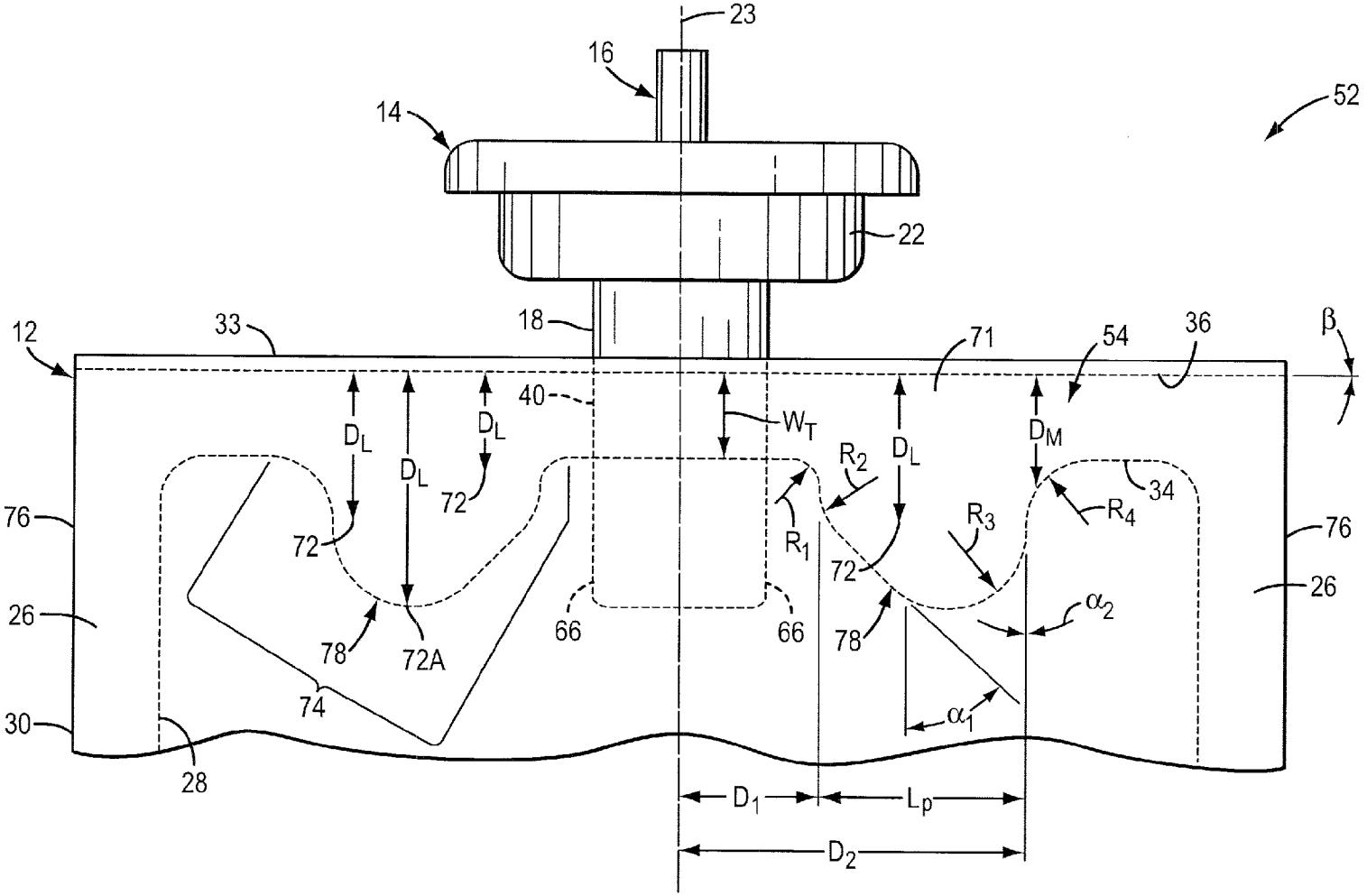
FIG. 8 is a side elevation view of the upper portion of a Bag-On-Valve construction according to the invention.

As best seen in FIG. 8, in one highly preferred embodiment, the package 52 is provided with a robust weld configuration 54 in the form of an end weld 71 at the dispensing end 33 of the pouch 12 that significantly reduces the failures discussed in the Background Section of the application. In this regard, it can be seen that the web portions 24 are welded to each other at locations 72 spanning a weld zone or area 74. In this regard, it should be understood that a location 72 is defined as any point within the weld zone 74. Thus, each of the weld zones 74 includes a plurality of locations 72. The locations 72 and weld zones 74 are symmetrical to each other and are spaced laterally on each side of the longitudinal axis 23, spaced laterally inwardly from the edge welds 26, and spaced from the outer weld margin 36 of the end weld 71 by distances $D_L$ that are greater than the width $W_T$ as measured along a line extending from the locations 72 to the outer weld margin 36 normal to the slope β (slope of 0° shown in FIG. 8) of the outer weld margin 36 at the point where the line intersects the outer weld margin 36. The welds can be formed using any suitable method, including any of those discussed in the Background Section of this application.

In the embodiment of FIG. 8, the locations 72 are defined within the end weld 71. In this regard, the inner weld margin 34 of the end weld 71 is spaced from the outer weld margin 36 by a distance $D_M$ measured along a line normal to the slope β of the outer weld margin 36, with the distance $D_M$ increasing in magnitude from $W_T$ to the $D_L$ of the outermost location 72A and then decreasing in magnitude from $D_L$ as the inner weld margin 34 extends in a direction away from the axis 23 toward the opposite lateral edges 76 of the pouch 12. This construction forms downwardly projecting protrusions 78 that contain the locations 72 and the zones 74. These protrusions 78 can be defined based upon a number of dimensional parameters, including, for example, the distances $D_1$ and $D_2$ from the longitudinal axis 23, the blend radiuses $R_1$, $R_2$, $R_3$ and $R_4$, the angles $\alpha_1$ and $\alpha_2$, and/or the lateral length $L_P$. In one highly preferred embodiment for use with a tailpiece such as shown in FIGS. 6 and 7 and having the dimensions $L_1$=0.234", and R=0.166", the dimensional parameters $D_1$=0.401", $D_2$=1.001", $R_1$=0.075", $R_2$=0.197", $R_3$=0.236", $R_4$=0.177", $\alpha_1$=45°, $\alpha_2$=0°, and $L_P$=0.600".

Figure 1:
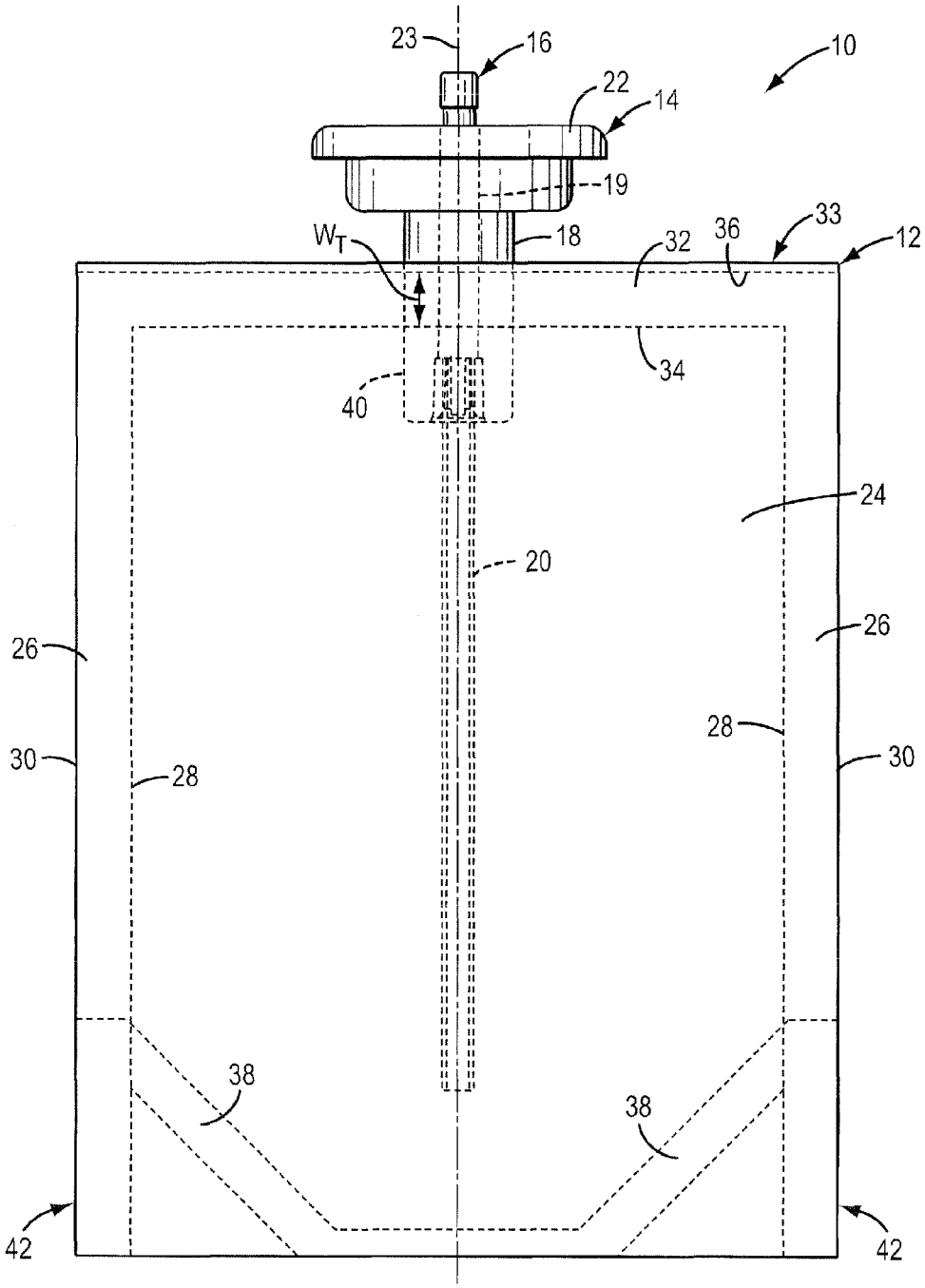
FIG. 1 (PRIOR ART)
FIGS. 1-4 are side elevation views of prior art Bag-On-Valve constructions.
Figure 2:
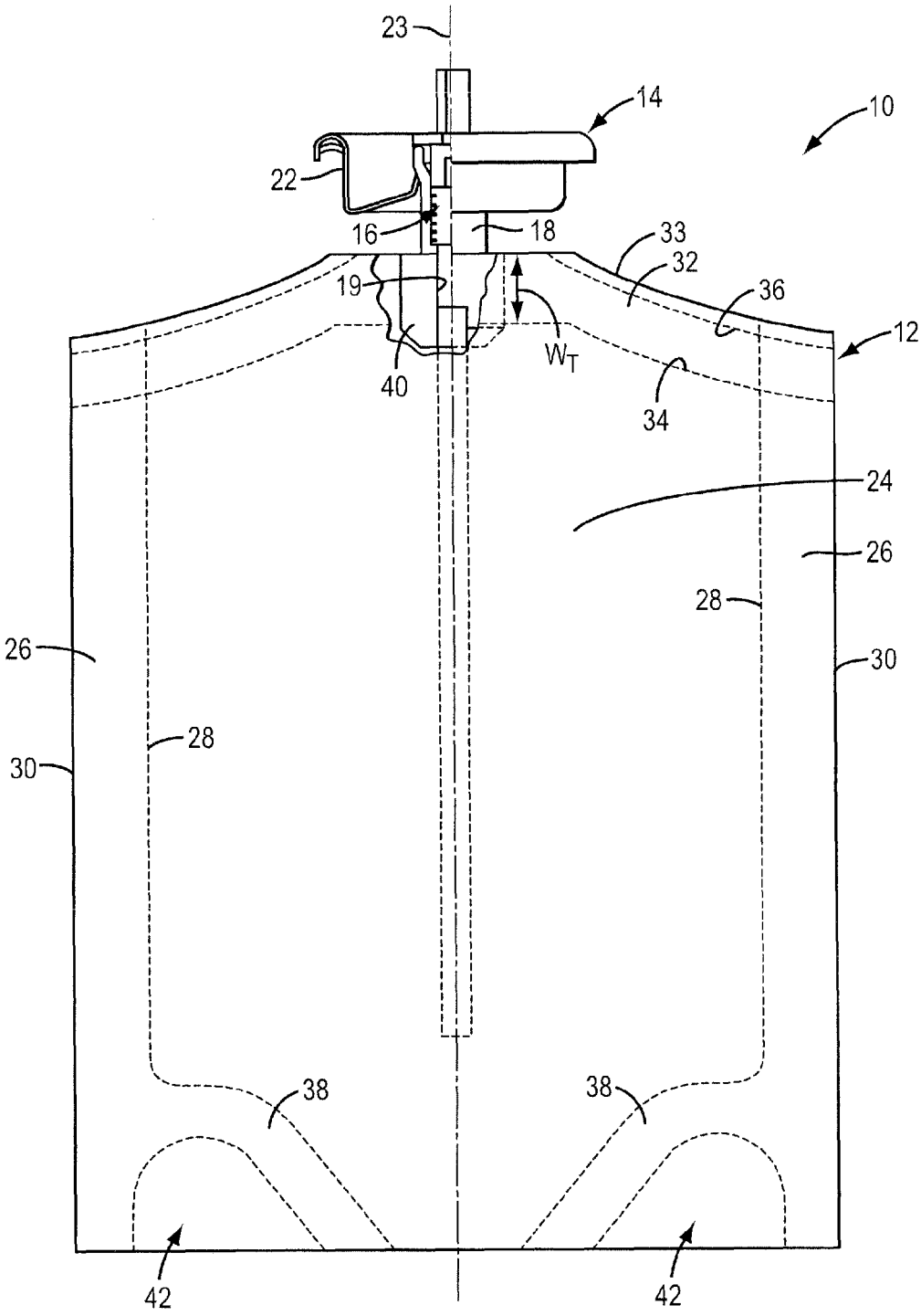
FIG. 2 (PRIOR ART)
Figure 3:
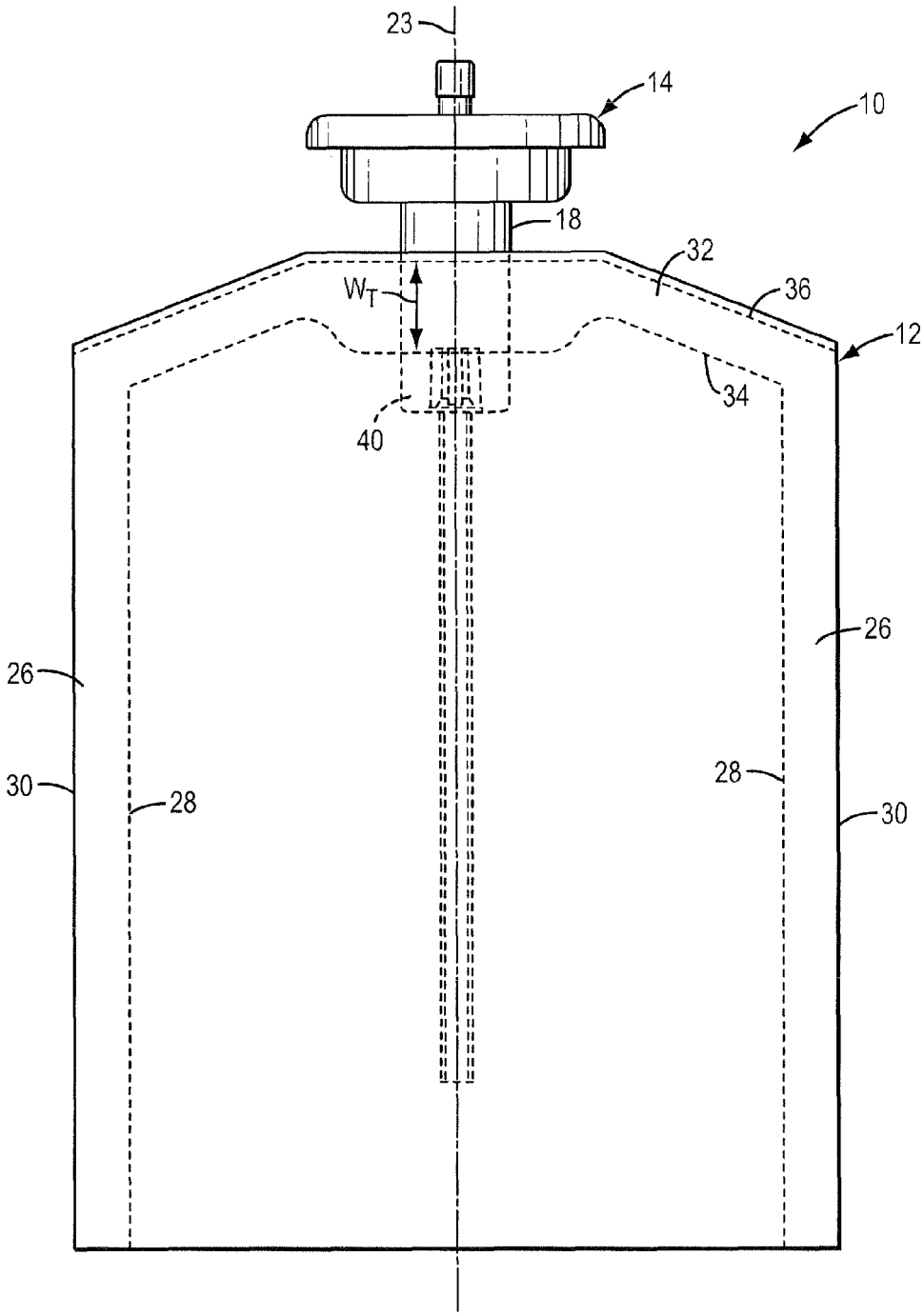
FIG. 3 (PRIOR ART)
Figure 4:
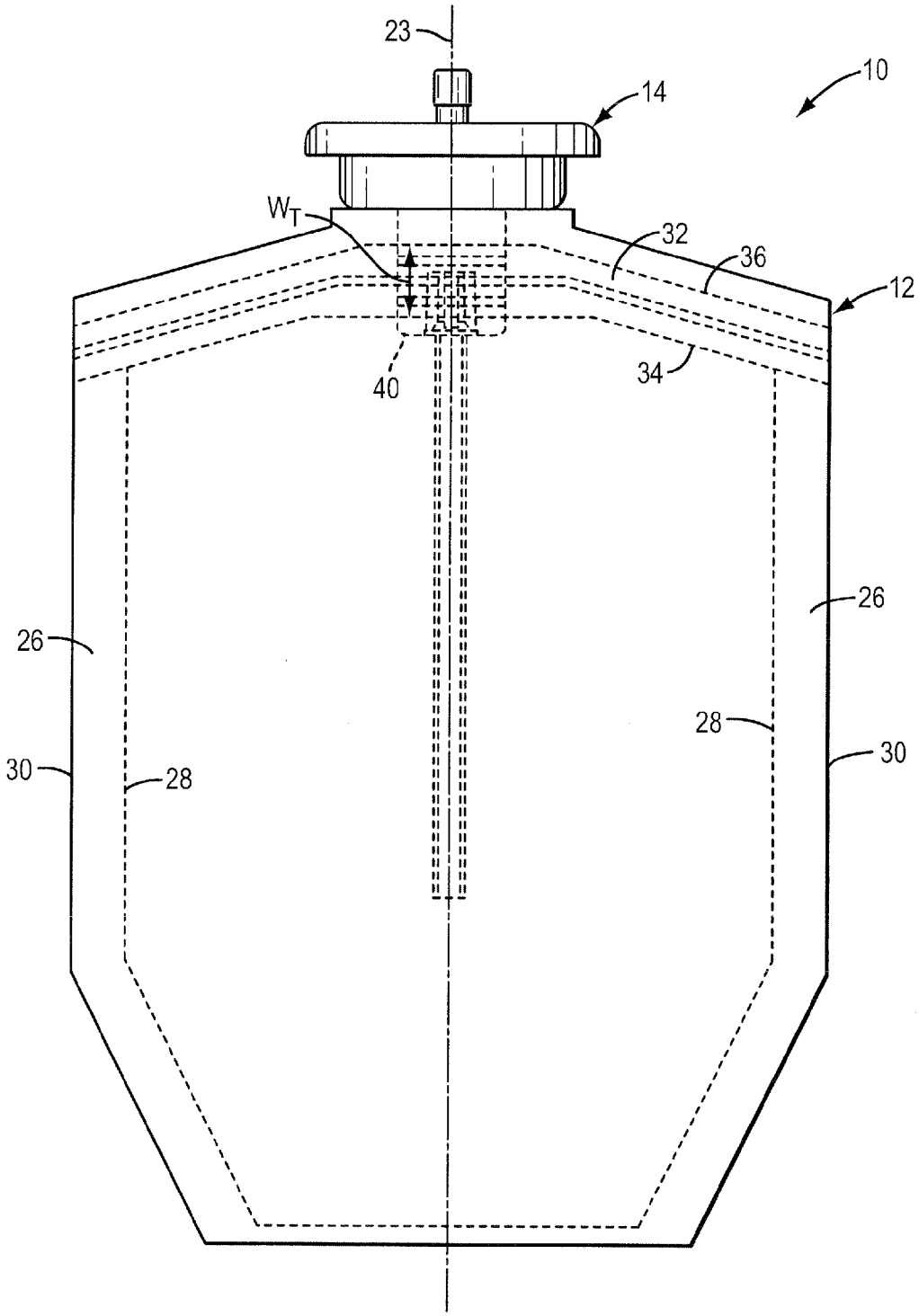
FIG. 4 (PRIOR ART)
Figure 9:
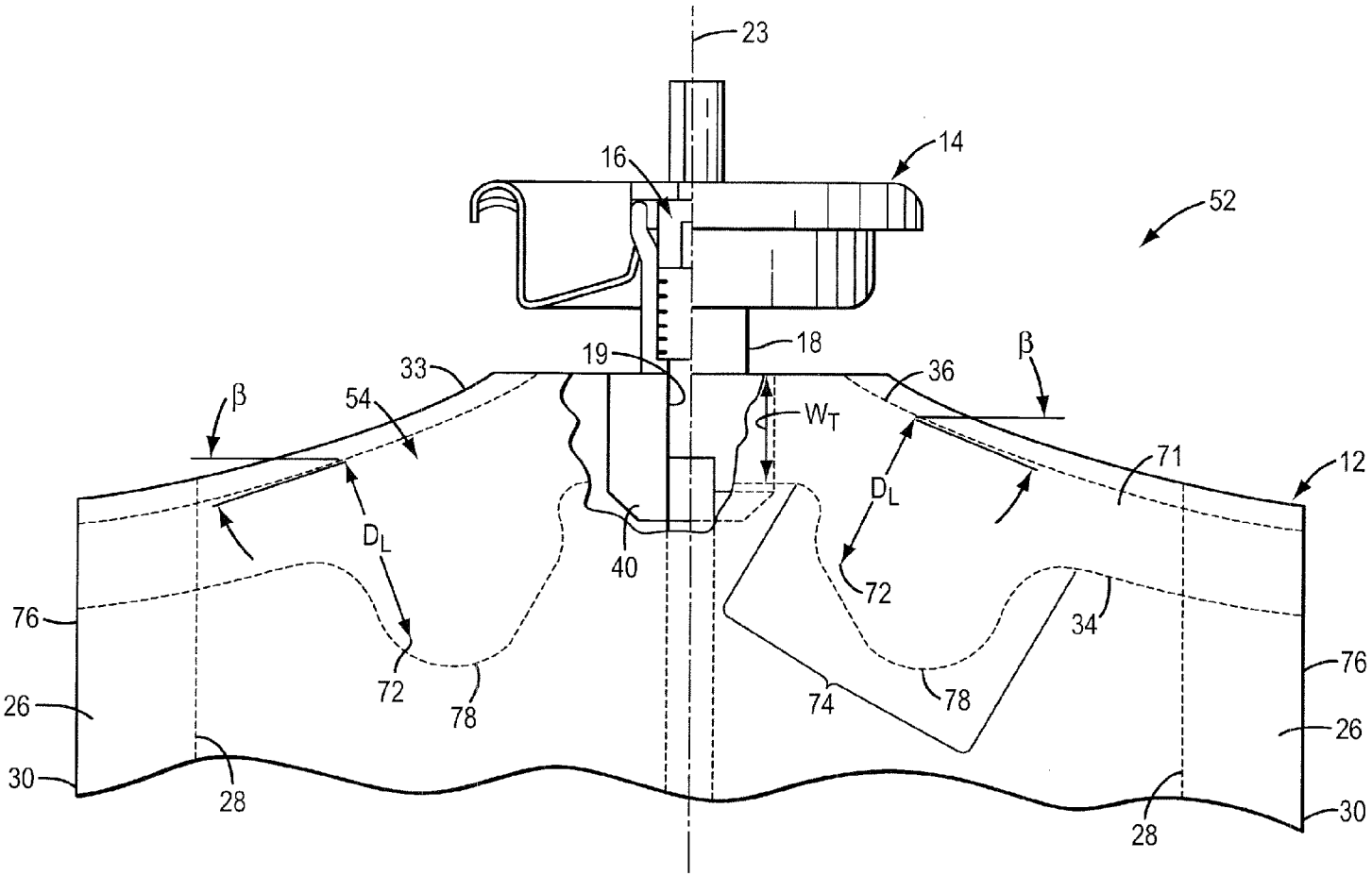
FIGS. 9-18 are views similar to FIG. 8, but showing alternate embodiments of Bag-On-Valve packages according to the invention.
Figure 10:
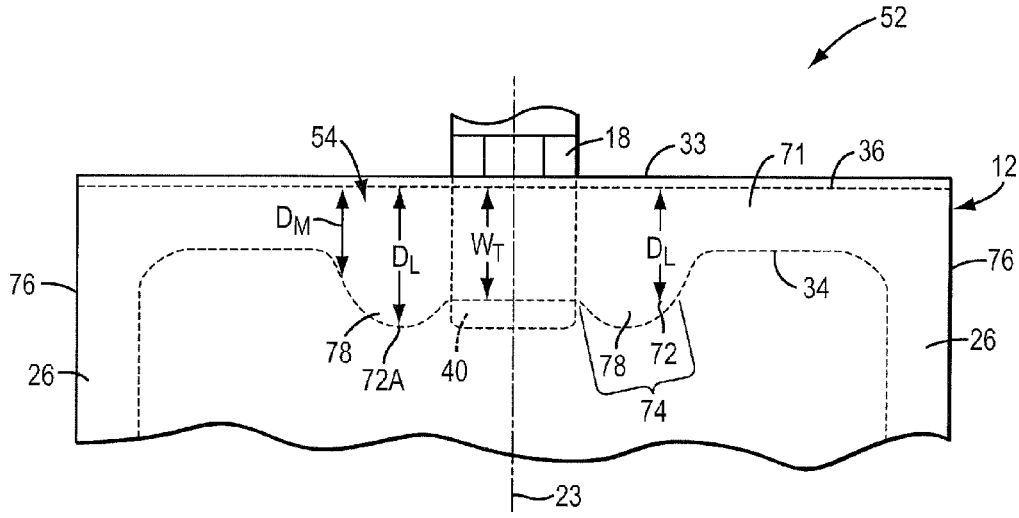
Figure 11:
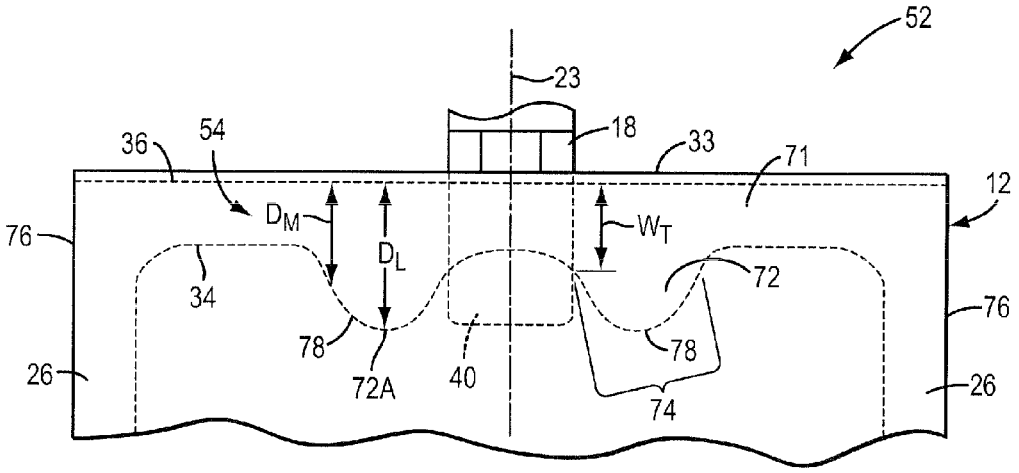
Figure 12:
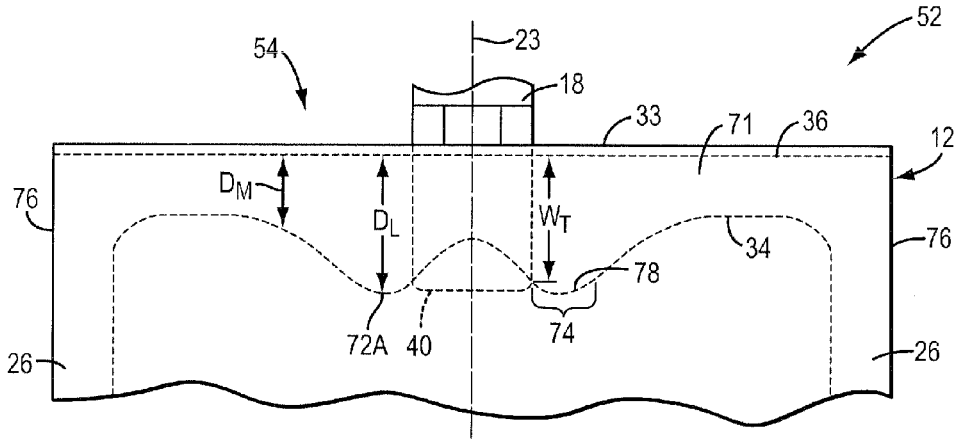
Figure 13:
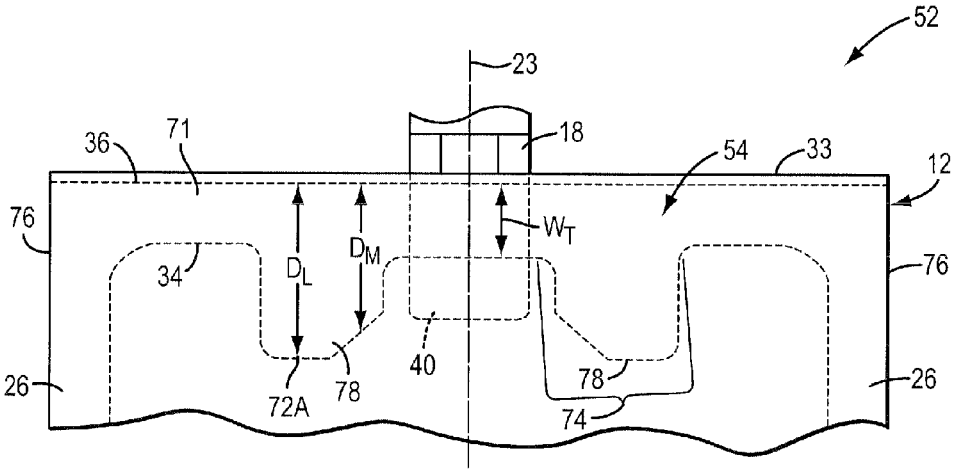
Figure 14:
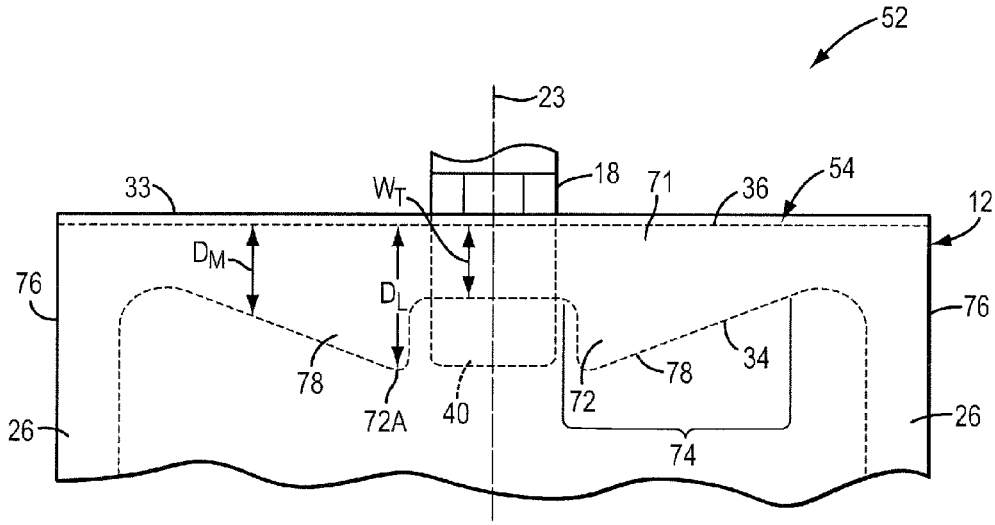
Figure 15:
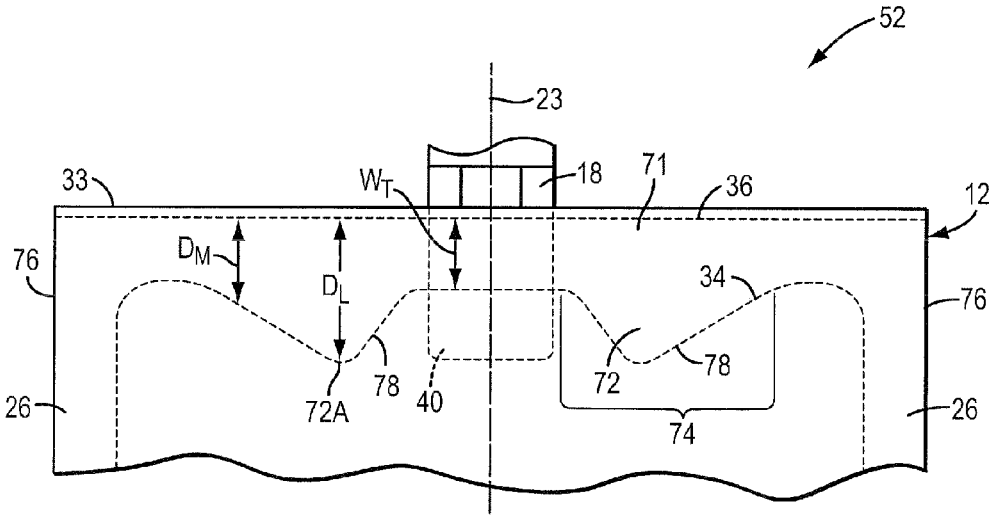
Figure 16:
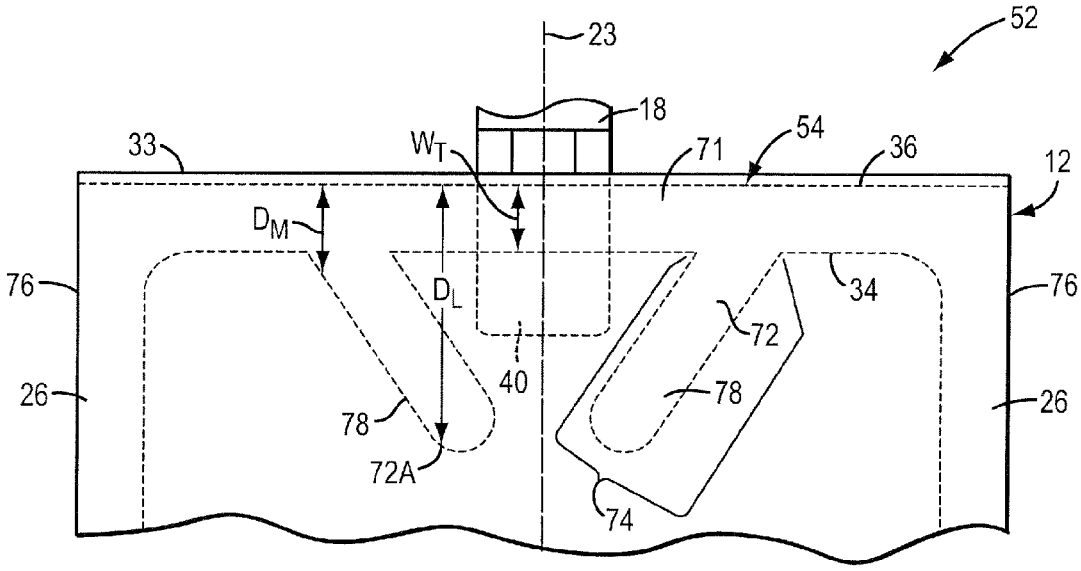
Figure 17:
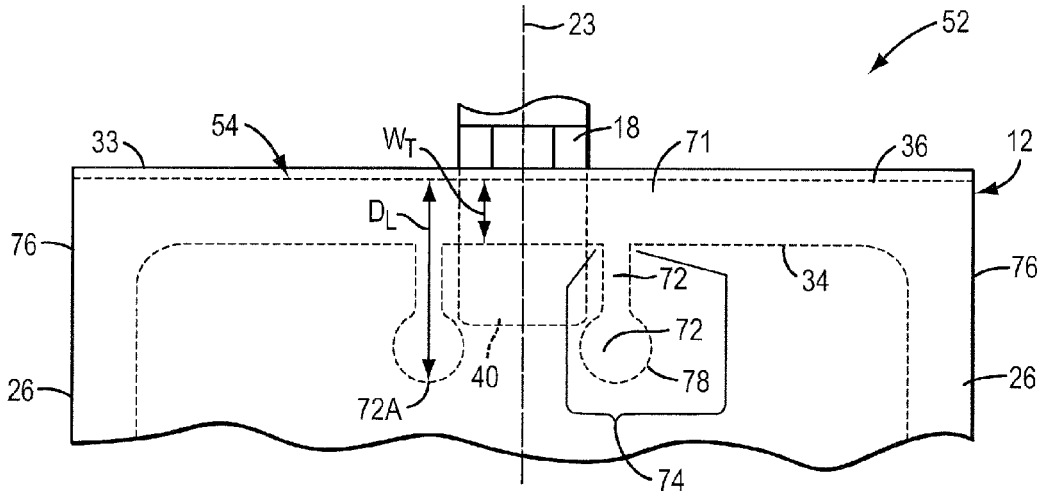

FIG. 9 shows an embodiment similar to FIG. 8, but unlike FIG. 8, the outer weld margin 36 of FIG. 9 does not extend laterally in a continuous straight line from the axis 23 to the edge welds 26. Rather, the outer weld margin 36 of FIG. 9 is nonlinear as it extends in a direction away from the longitudinal axis 23 toward the lateral edges 76 of the pouch 12. It can be seen from FIG. 9 that the slope β of the outer weld margin 36 is less than 0° at all of the points of intersection with the normal lines extending from the locations 72 contained within the protrusions 78. Other possible shapes for the outer weld margin 36 are can be seen in the prior art of FIGS. 3 and 4, both of which show outer weld margins with linear segments that do not extend laterally in a continuous straight line from the axis 23 to the side welds 26.

Figure 18:
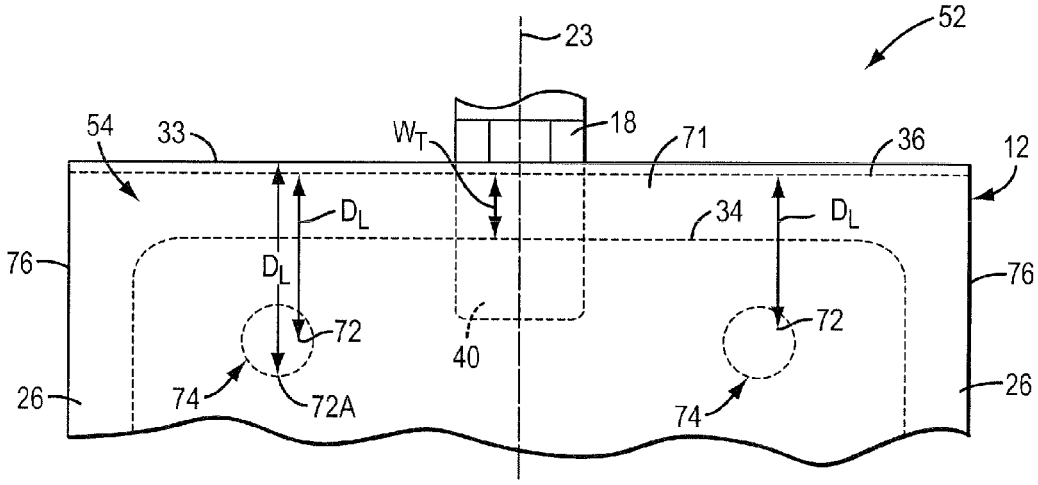

It should be understand that FIGS. 8 and 9 illustrate just two of the many possible shapes for end weld 71 that can provide the desired weld locations 72 within a weld zone 74. As an illustration of some of the many possible shapes, FIGS. 10-17 show various examples of alternate embodiments wherein the shape of the inner weld margin 34 has been altered to provide different shapes and locations of the protrusions 78 and the associated locations 72 and weld zones 74. Furthermore, it should be understood that the locations 72 and weld zones 74 do not have to be part of the end weld 71 and may be spaced from the end weld 71, as shown in FIG. 18 which illustrates one example of a robust weld configuration 54 wherein the locations 72 and weld zones 74 are spaced from the end weld 71 rather than being within the end weld 71

Testing on various configurations have shown that, in general, and with all other parameters being equal:

a) locations 72 that are spaced laterally closer to the longitudinal axis 23 tend to perform better than locations 72 that are spaced further from the longitudinal axis 23, with locations 72 that are spaced laterally within $4.5*W_T$ of the longitudinal axis 23 tending to perform better than locations that fall outside of that range;

b) locations 72 with a $D_L$ that is too close in magnitude to $W_T$ or with a magnitude too far from $W_T$ can perform poorly, with locations having a $D_L$ that is between $1.1*W_T$ to $4.5*W_T$ tending to perform better than locations 72 falling outside of that range;

c) locations 72 associated with a larger area or zone 74 of weld tend to perform better than locations 72 associated with a smaller area or zone 74 of weld, with locations 72 associated with an area of weld at least as large as $\pi*(W_T/16)^2$ tending to perform better than locations associated with a smaller area of weld; and d) protrusions 78 with larger lateral lengths $L_P$ tend to outperform protrusions with smaller lateral lengths $L_P$, with protrusions having a length $L_P$ that is at least as large in magnitude as $W_T$ tending to outperform protrusions having a smaller magnitude length $L_P$.

It should be understood that in some applications, trends may develop other than those identified above in subparagraphs a) through d), and that the invention is not limited to any of the above trends unless expressly recited in a claim.

It should be understood that while the illustrated embodiments show the locations 72, zones 74, and protrusions 78 as being symmetrical, in some applications it may be desirable for the locations 72, zones 74 and/or protrusions 78 to be asymmetrical.

It should also be understood that while the invention has been described herein in connection with a pressurized unit 50, the invention may find use in other applications that utilize BOV packages.

What is claimed is:

1. A package for containing and dispensing a fluent product, the package comprising:

a fitment body having a tailpiece defining a dispensing passage extending along a longitudinal axis; and a collapsible pouch for containing a fluent product to be dispensed, the pouch defined by at least two opposing, flexible, web portions, the fitment body located at a dispensing end of the pouch with the tailpiece being sandwiched between the flexible web portions, the flexible web portions being welded to each other to define a pair of laterally spaced, longitudinally extending edge welds, and further being welded to each other and to the tailpiece to define an end weld bounded by inner and outer weld margins extending laterally across the pouch at the dispensing end, the portion of the end weld extending across the tailpiece having a maximum width $W_T$ parallel to the longitudinal axis, the flexible web portions being welded to each other at a pair of locations, the locations spaced laterally from each other on opposite sides of the longitudinal axis, wherein each of the locations is spaced laterally from the edge welds, and each of the locations is spaced from the outer weld margin by a distance $D_L$ that is greater than the width $W_T$, with $D_L$ being measured along a line extending from the location to the outer weld margin normal to the slope of the outer weld margin at the point where the line intersects the outer weld margin.

2. A package as claimed in claim 1 wherein the outer weld margin is a straight line extending normal to the longitudinal axis.

3. A package as claimed in claim 1 wherein the outer weld margin does not extend in a continuous straight line from the central axis to the edge welds.

4. A package as claimed in claim 1 wherein the locations are symmetrical about the longitudinal axis.

5. A package as claimed in claim 1 wherein the locations are spaced from the end weld.

6. A package as claimed in claim 1 wherein the locations are defined within the end weld.

7. A package as claimed in claim 6 wherein the inner weld margin is spaced from the outer weld margin by a distance $D_M$ measured along a line extending normal to the slope of the outer weld margin, the distance $D_M$ increasing in magnitude from $W_T$ to $D_L$ as the inner weld margin extends laterally from the axis to each of the locations and then decreasing from $D_L$ as the inner weld margin extends laterally from each of the locations toward opposite lateral edges of the pouch.

8. A package as claimed in claim 1 wherein the locations are spaced from the longitudinal axis so as to not underlie the tailpiece.

9. A package as claimed in claim 1 wherein the lateral spacing of the locations from the longitudinal axis is not greater than $4.5*W_T$.

10. A package as claimed in claim 1 wherein the $D_L$ for each of the locations is greater than $1.1*W_T$.

11. A package as claimed in claim 1 wherein the $D_L$ for each of the locations is less than $4.5*W_T$.

12. A package as claimed in claim 1 wherein each of the locations is associated with a continuous area of weld that is at least equal to $\pi*(W_T/16)^2$.

13. A package as claimed in claim 1 wherein the tailpiece has a non-circular transverse cross-section.

14. A package as claimed in claim 13 wherein the transverse cross-section of the tailpiece does not vary over a longitudinal portion of the tailpiece bounded by the inner and outer weld margins.

15. A package as claimed in claim 14 wherein the transverse cross-section is generally diamond-shaped.

* * * * *